US009017139B2

(12) United States Patent
Ronshaugen et al.

(10) Patent No.: US 9,017,139 B2
(45) Date of Patent: Apr. 28, 2015

(54) LAPPING CARRIER HAVING HARD AND SOFT PROPERTIES, AND METHODS

(71) Applicant: Seagate Technology LLC, Cupertino, CA (US)

(72) Inventors: Marc Perry Ronshaugen, Eden Prairie, MN (US); Joel W. Hoehn, Hudson, WI (US)

(73) Assignee: Seagate Technology LLC, Cupertino, CA (US)

( * ) Notice: Subject to any disclaimer, the term of this patent is extended or adjusted under 35 U.S.C. 154(b) by 144 days.

(21) Appl. No.: 13/797,008

(22) Filed: Mar. 12, 2013

(65) Prior Publication Data

US 2014/0273764 A1 Sep. 18, 2014

(51) Int. Cl.

| | |
|---|---|
| ***B24B 49/10*** | (2006.01) |
| ***B24B 37/27*** | (2012.01) |
| ***B24B 37/04*** | (2012.01) |

(52) U.S. Cl.

CPC ..... *B24B 37/27* (2013.01); *B24B 37/048* (2013.01)

(58) Field of Classification Search

CPC ..... B24B 49/10; B24B 49/14; B24B 41/06; B24B 37/27; B24B 37/048

USPC ..... 451/5, 7, 28, 55, 53, 57

See application file for complete search history.

(56) References Cited

U.S. PATENT DOCUMENTS

| | | | | |
|---|---|---|---|---|
| 4,457,114 | A * | 7/1984 | Hennenfent et al. | 451/53 |
| 4,914,868 | A | 4/1990 | Church et al. | |
| 5,117,589 | A * | 6/1992 | Bischoff et al. | 451/405 |
| 6,475,064 | B2 | 11/2002 | Hao et al. | |
| 6,568,992 | B1 | 5/2003 | Angelo et al. | |
| 6,609,949 | B2 | 8/2003 | Anderson et al. | |
| 6,679,762 | B2 * | 1/2004 | Fatula et al. | 451/53 |
| 6,736,704 | B2 | 5/2004 | Kennedy et al. | |
| 6,881,124 | B2 * | 4/2005 | Takahashi et al. | 451/5 |
| 6,945,847 | B2 * | 9/2005 | Ota et al. | 451/7 |
| 7,086,931 | B2 * | 8/2006 | Oyama et al. | 451/7 |
| 8,066,547 | B1 | 11/2011 | Schuh et al. | |
| 8,137,157 | B2 | 3/2012 | Fletcher et al. | |
| 2008/0019050 | A1 * | 1/2008 | Kameyama | 360/235.4 |
| 2010/0134915 | A1 * | 6/2010 | Sasaki et al. | 360/59 |

* cited by examiner

*Primary Examiner* — Robert Rose
(74) *Attorney, Agent, or Firm* — HolzerIPLaw, PC

(57) ABSTRACT

A carrier for a slider row bar for a lapping process. The carrier has a mounting structure comprising a material configured to have a first modulus of at least 1,000,000 Pa at a first period of time and a second modulus of 500 Pa to 500,000 Pa at a second period of time subsequent to the first period. The change from the first modulus to the second modulus is due to an external stimulus on the material.

20 Claims, 2 Drawing Sheets

LAPPING CARRIER HAVING HARD AND SOFT PROPERTIES, AND METHODS

BACKGROUND

Hard disc drive systems (HDDs) typically include one or more data storage discs. A transducing head carried by a slider is used to read from and write to a data track on a disc. The slider is carried by an arm assembly that includes an actuator arm and a suspension assembly, which can include a separate gimbal structure or can integrally form a gimbal.

The sliders, as well as the transducing heads, are typically produced by using thin film deposition techniques. In a typical process, an array of sliders are formed on a common substrate or wafer which is then sliced to produce bars, with a row of sliders in a side-by-side pattern on each bar. The bars are then mounted on a carrier tool and lapped to obtain the desired physical configuration, which provides the electrical performance.

The lapping process is a multiple step process, beginning with a stock removal step, often called a 'rough lapping' step, and ending with a polishing step, often called "kiss lapping" or "polishing lapping" step. The rough lapping step, when as much as 20 microns of material might be removed from the slider bar, is an aggressive lapping process that requires good adhesion of the slider bar to the carrier tool in order to avoid a large twist being lapped into the bar. Conversely, the kiss lapping step is a final polishing and precision shaping step, much less aggressive than the rough lapping step, usually removing no more than 100 nanometers of material. The kiss lapping step does not require the rigidity as during the rough lapping step, but does require a conformal mounting to achieve the desired crown on the slider bar.

Because of the different requirements of the different lapping steps, a different carrier and mounting adhesive is used to secure the slider bar during the different steps. Removing the slider bar from a first carrier, and transferring to a second carrier, adds time, effort and significant cost to the lapping process. Improvements in the process are desired.

SUMMARY

The present disclosure provides improvements over conventional lapping processes, by eliminating the need to change bar carriers among the various lapping steps.

One particular embodiment of this disclosure is a carrier for a slider row bar for a lapping process. The carrier has a mounting structure comprising a material configured to have a first modulus of at least 1,000,000 Pa at a first period of time and a second modulus of 500 Pa to 500,000 Pa at a second period of time subsequent to the first period. The change from the first modulus to the second modulus is due to an external stimulus on the material.

Another particular embodiment of this disclosure is a carrier having a rigid base and a mounting structure for attachment of the slider row bar thereto. The mounting structure includes a plurality of layers, with one of the layers configured to have a shear modulus of at least 1,000,000 Pa at a first period of time and a shear modulus of no more than 500,000 Pa at a second period of time subsequent to the first period. The change in modulus is due to an external stimulus on the material.

Another particular embodiment of this disclosure is a method of lapping a slider row bar. The method comprises mounting a slider row bar onto a carrier, a portion of the carrier having a first shear modulus; rough lapping the slider row bar while mounted on the carrier; applying a stimulus to the carrier to change the first shear modulus to a second shear modulus; and after applying the stimulus, kiss lapping the slider row bar while mounted on the carrier.

These and various other features and advantages will be apparent from a reading of the following detailed description.

BRIEF DESCRIPTION OF THE DRAWING

The disclosure may be more completely understood in consideration of the following detailed description of various embodiments of the disclosure in connection with the accompanying drawing, in which.

DETAILED DESCRIPTION

Figure 1:
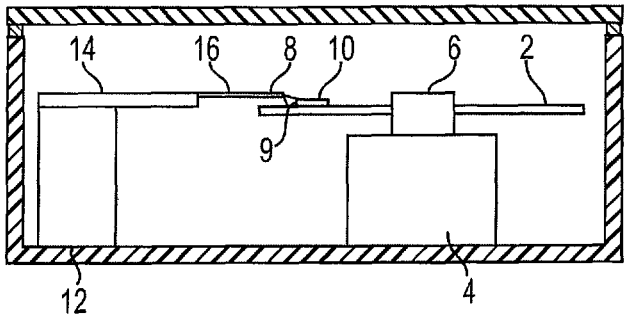
FIG. 1 is a sectional side view of a magnetic recording disc drive and slider assembly.

The present embodiments relate most generally to workpiece carriers used during a lapping process. For purposes of this description, although not so limited, reference is made to the use of the carriers in high precision lapping of sliders and the supported magnetic transducing heads used in data storage devices (e.g., disc drives). The sliders and particularly the heads, operably used to store and retrieve data on rotatable magnetic recording discs, require extremely precise manufacturing tolerances. The present disclosure provides carrier tools that can be used for both a rough lapping process used for high stock removal and for a fine or kiss lapping process used for final polishing and shaping.

To achieve the correct stripe height and breakpoint dimensions on a read/write transducing head, an actuated lapping process with closed-loop resistance feedback is used. The slider bar, having multiple read/write heads thereon, is secured (e.g., glued) to a carrier tool having individual fingers, which are capable of bending or otherwise adjusting the position of the slider bar and even each slider to achieve the target configuration. The carrier is a rigid mount configured to withstand the high stock removal lapping shear forces.

However, a problem lies with gluing or otherwise securing the slider bar to the carrier. During mounting, particularly due to the curing of the adhesive, multiple stresses are introduced to the slider bar that distort the slider bar. Lapping the distorted slider bar results in poor crown dimensions, a possible cross crown, and possible twisted bar for the slider bar when unmounted from the carrier. Efforts have been made to "soft-mount" the slider bar with a softer adhesive, resulting in significantly better shape control but in poor stripe height and breakpoint control. To solve this problem, a multiple step lapping process is done. First, rough lapping is done with the slider bar rigidly adhered to the carrier, and subsequent polish or kiss lapping is done with a softer mount, to correct the distortion caused by the rigid mount. These multiple lap steps require multiple mounting, bonding, and cleaning steps.

The carrier tools of this disclosure, during a rough lapping process, have a rigid configuration, whereas during a fine or kiss lapping process, have a soft configuration. The carrier tools include at least one feature (e.g., a layer) that has a shear modulus that can be changed, by the application of external stimulus, from a high modulus to a low modulus material.

In the following description, reference is made to the accompanying drawing that forms a part hereof and in which are shown by way of illustration at least one specific embodiment. The following description provides additional specific embodiments. It is to be understood that other embodiments are contemplated and may be made without departing from the scope or spirit of the present disclosure. The following detailed description, therefore, is not to be taken in a limiting sense. While the present disclosure is not so limited, an appreciation of various aspects of the disclosure will be gained through a discussion of the examples provided below.

Unless otherwise indicated, all numbers expressing feature sizes, amounts, and physical properties are to be understood as being modified by the term "about." Accordingly, unless indicated to the contrary, the numerical parameters set forth are approximations that can vary depending upon the desired properties sought to be obtained by those skilled in the art utilizing the teachings disclosed herein.

As used herein, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

Figure 2:
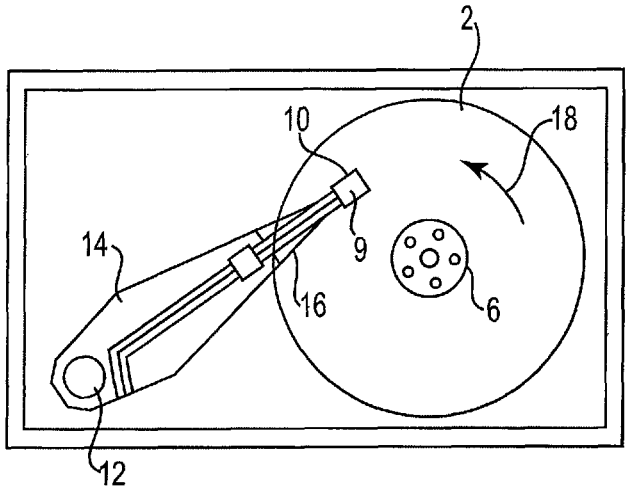
FIG. 2 is a top view of the magnetic recording disc drive and slider assembly of FIG. 1.

Referring to FIGS. 1 and 2, a generic magnetic recording disc drive is illustrated, having a magnetic recording disc 2 which is rotated by drive motor 4 with hub 6 which is attached to the drive motor 4. A read/write head or transducer 8 is present on the trailing end or surface 9 of a slider 10. Slider 10 is connected an actuator 12 by means of a rigid arm 14 and a suspension element 16. Suspension element 16 provides a bias force which urges slider 10 toward the surface of disc 2. During operation of the disc drive, drive motor 4 rotates disc 2 at a constant speed in the direction of arrow 18 and actuator 12 which is typically a linear or rotary motion coil motor drives slider 10 generally radially across the plane of the surface of disc 2 so that read/write head 8 may access different data tracks on disc 2.

In order to meet the increasing demands for more and more data storage capacity on disc 2, slider fabrication and finishing must be improved to meet these demands. To meet these demands, lapping and polishing methodology must be developed which enhance slider features. Typically, numerous sliders are fabricated from a single wafer having rows of magnetic transducer heads deposited simultaneously on the wafer surface using semiconductor-type process methods. Single-row bars are sliced from the wafer, each bar being a row of units that are further processed into sliders each having one or more magnetic transducers or heads on their end faces. Each bar is bonded to a carrier fixture or tool for processing by lapping and then further diced i.e., separated into individual sliders.

In order to achieve maximum efficiency of the slider during use, the head, particularly the sensing elements of the head, must have precise dimensions. During manufacturing, it is most critical to grind or lap these elements to very close tolerances in order to achieve the unimpaired functionality required of sliders. The present disclosure provides a carrier tool that can be used for multiple steps during the lapping process of the slider row bar.

Figure 3:
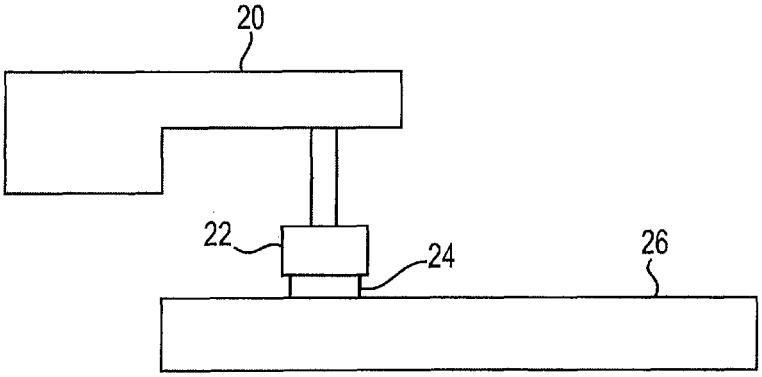
FIG. 3 is a schematic side view of an embodiment of a lapping process.

FIG. 3 schematically depicts a lapping arrangement used for dimensioning a slider bar. To an actuator or fixture 20 is operably connected a carrier 22 according to the present disclosure, which has mounted thereon a slider row bar 24. Slider bar 24 is illustrated in contact with a lapping plate 26 (also often referred to as a platen). Not shown in FIG. 3, present on lapping plate 26 is a plurality of abrasive particles. The abrasive particles may be present in a slurry or may be fixed to the surface of lapping plate 26, for example by adhesive or by electroplate. In use, lapping plate 26 is rotated relative to a slider bar 24 held in a pressing engagement against the working surface of lapping plate 26. The abrading action due to the abrasive particles removes material from slider bar 24 and provides the desired shape.

In accordance with this disclosure, carrier 22 can be used for both a rough lapping step and a final, polish, or kiss lapping step. Carrier 22 includes a feature (e.g., a layer) that has a shear modulus that can be changed, by the application of external stimulus, from a high modulus to a low modulus material.

Figure 4:
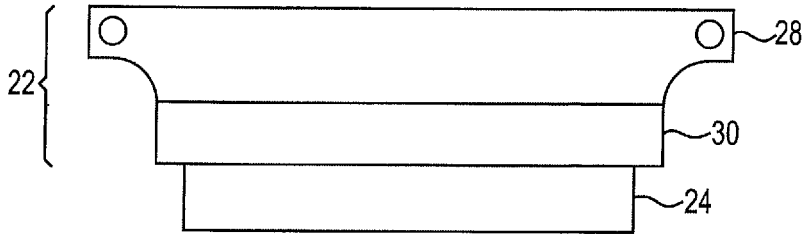
FIG. 4 is a schematic side view of a carrier tool according to the present disclosure having secured thereon a slider row bar.

Referring to FIG. 4, an embodiment of carrier 22 according to this disclosure is illustrated having secured thereto slider row bar 24. Carrier 22 includes a conventional support base 28, for mounting carrier 22 to fixture 20. Base 28 is a rigid base, typically formed from material such as metal, glass, polymer, or ceramic; ceramic and stainless steel are two commonly used materials. Base 28 may be a single piece or multiple piece fixture, be a solid fixture or have an intricate design, and may include any number of various features, such as pliable fingers or nodes (see for example, U.S. Pat. No. 8,066,547 to Schuh et al.), actuation points along the length of carrier 22 (see for example, U.S. Pat. No. 6,475,064 to Hao et al.), and other elements designed to improve the dimensions of the sliders and the lapping process. Base 28 may have incorporated therewith circuitry (e.g., flexible circuitry) for monitoring the stock removal from row bar 24 (see for example, U.S. Pat. No. 6,609,949 to Anderson et al.).

Carrier 28 includes a mounting structure 30 for securing slider row bar 24 to base 28. Mounting structure 30 may be a single layer structure or may be multi-layer, however in either configuration, mounting structure 30 is secured to base 28 via an adhesive surface and to slider row bar 24 via an adhesive surface. It is mounting structure 30, or at least a portion thereof, that can be changed from a high modulus to a low modulus material. In some embodiments, the modulus may subsequently be returned to the high modulus.

During a rough lapping step, mounting structure 30, or at least the portion thereof, has a sufficiently high modulus to withstand the shear stresses introduced thereon. Typically, the shear modulus (G) is at least 1,000,000 Pa (1,000 KPa), often at least 2,000,000 Pa (2,000 KPa). In some embodiments, the shear modulus may be 3,000,000 Pa (3,000 KPa) to 5,000,000 Pa (5,000 KPa). During a subsequent polish or kiss lapping step, mounting structure 30, or at least the portion thereof, has a sufficiently low modulus to conform to irregularities. Typically, the shear modulus (G) is no more than 500,000 Pa (500 KPa), often no more than 300,000 Pa (300 KPa) or 200,000 Pa (200 KPa). In some embodiments, the shear modulus may be 100,000 Pa (100 KPa) to 200,000 Pa (200 KPa). For most embodiments, the shear modulus is greater than 500 Pa or greater than 1,000 Pa.

In one embodiment, mounting structure 30 includes a polymeric material that, when at a temperature below its glass transition temperature (Tg) has a shear modulus of at least 1,000,000 Pa (1,000 KPa) or at least 2,000,000 Pa (12,000 KPa), and when above its glass transition temperature (Tg), yet below its melting temperature (Tm), has a shear modulus of no more than 500,000 Pa (500 KPa) or no more than 300,000 Pa (300 KPa).

The polymeric material may be a thermoset, a thermoplastic (e.g., a thermoplastic elastomer) or combinations thereof. Examples of suitable polymeric materials include thermoset polyurethanes, thermoplastic polyurethanes and combinations thereof. Polyurethanes formed from the reaction of hydroxyl terminated polyether or hydroxyl terminated polyester prepolymers with diisocyanates may be employed. Crosslinking of the polyurethane may be desirable.

The polymeric material may be a coating on base 28 or on a subsequent layer, or the polymeric material may be a film applied on base 28 or on a subsequent layer. In some embodiments, an adhesion promoting layer may be present between base 28 and the polymeric material to improve the integrity or adhesion properties. The adhesion promoting layer improves the adhesion between base 28 and the polymeric material. The adhesion promoting layer may comprise multiple layers of similar chemical composition or may comprises multiple layers having distinct chemical compositions.

After applying the polymeric material to base 28, to an adhesion promoting layer, or to any other layer, further processing such as drying, annealing and/or curing of the material may be required in order for the polymeric material to reach its optimal utility. In some embodiments, the polymeric material may comprise multiple layers of the material or of chemically distinct polymers.

In addition to possessing appropriate modulus properties above and below its glass transition temperature, the polymeric material should be able to withstand the chemical environment of the lapping operation without undue degradation of its properties. Polymers such as polyurethanes, epoxies, and certain polyesters typically have the desired chemical resistance to the working fluids used during the lapping process.

In one example, mounting structure 30 is a multi-layer element composed of a silicone film layer, a polyester (e.g., Mylar™) layer, and a press-sensitive adhesive layer, where the silicone layer has a shear modulus of about 80,000 GPa when below its glass transition temperature and a shear modulus of less than 500,000 Pa (500 KPa) above its glass transition temperature. Mounting structure 30 can be arranged with the silicone layer adjacent to base 28 or adjacent to row bar 24.

Figure 5:
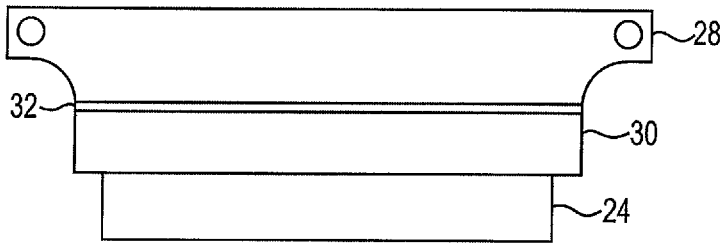
FIG. 5 is a schematic side view of another carrier tool according to the present disclosure having secured thereon a slider row bar.
Figure 6:
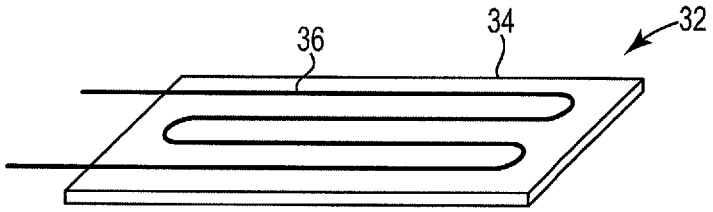
FIG. 6 is a schematic perspective view of a heater suitable for use with the carrier tool of FIG. 5.

To switch the shear modulus of the polymeric material in carrier 22 when desired, a heating element can be included in carrier 22. FIG. 5 illustrates an embodiment where a thin-film heater 32 is provided between base 28 and mounting structure 30, which includes the polymeric material. FIG. 6 illustrates thin-film heater 32, composed of a substrate 34 having a filament 36 thereon. Thin-film heater 32 may be positioned between mounting structure 30 and base 28, as illustrated in FIG. 5, or thin-film heater 32 may be a layer internal to mounting structure 30, for example, adjacent to the polymeric material to be heated. For example, for the multi-layer element disclose above, composed of a silicone film layer, a polyester layer, and a pressure-sensitive adhesive layer, heater 32 may be positioned between the silicone layer and the polyester layer.

In use, slider row bar 24 is attached (e.g., adhered) to carrier 22, particularly to base 28 via mounting structure 30 and heater 32. Carrier 22 with row bar 24 is mounted to actuator 20 (FIG. 3) so that row bar 24 can be processed on lapping plate 26. First, a rough lapping step is done, with heater 32 "off", so that the temperature of the polymeric material in mounting structure 30 is below its Tg and the modulus is at least 1,000,000 Pa. Subsequently, a kiss lapping step is done, with heater 32 "on", so that the temperature of the polymeric material in mounting structure 30 is above its Tg and the modulus is no more than 500,000 Pa.

In another embodiment, mounting structure 30 includes a polymeric material that, when at a first state, has a shear modulus of at least 1,000,000 Pa or at least 2,000,000 Pa, and, when in a second state, has a shear modulus of no more than 500,000 Pa or no more than 300,000 Pa. An external stimulus can be applied to this polymeric material to alter its modulus; examples of possible stimuli include voltage, current, potential, or other electrical stimulus, chemical stimuli (e.g., water, polar solvent, ionic solvent), temperature change (either increase or decrease), and radiation (e.g., UV radiation, X-ray, gamma). This polymeric material may be a coating on base 28 or on a subsequent layer. Mounting structure 30 may be formed only of this polymeric material, or may have additional layers.

An example of a polymeric material suitable for use in mounting structure 30 and thus carrier 22 is a polymer nanocomposite that turns from hard to soft on exposure to chemical stimuli, such as water. One particular example of such a material comprises rubber polymers, such as ethylene oxide/epichlorohydrin copolymer or polyvinyl acetate, into which strong and rigid nanofibers are embedded (see "Biomimetic smart polymer goes from hard to soft", by Rupal Mehta, Materials World Magazine, 1 Apr. 2008). In use, water or other stimuli would be applied to mounting structure 30 prior to or during the kiss lapping step, when the softer properties and lower modulus are desired.

In yet another embodiment, mounting structure 30 includes a non-polymeric material (e.g., metallic, ceramic, composite) that, when at a first state, has a shear modulus of at least 1,000,000 Pa or at least 2,000,000 Pa, and, when in a second state, has a shear modulus of no more than 500,000 Pa or no more than 300,000 Pa. An external stimulus can be applied to this non-polymeric material to alter its modulus; examples of possible stimuli include voltage, current, potential, or other electrical stimulus, chemical stimuli, and temperature change (either increase or decrease). Mounting structure 30 may be formed only of this non-polymeric material, or may have additional layers.

An example of a metallic material suitable for use in mounting structure 30 and thus carrier 22 of this disclosure is one that can change from hard to soft by applying an electric potential to the material to thus change the electronic structure of the material (see Helmholtz Association of German Research Centers (2011, Jun. 6) "Material Turns Hard or Soft at the Touch of a Button", available from ScienceDaily, www.sciencedaily.com/releases/2011/06/110606113106/htm). In use, electric potential or other stimuli would be applied to mounting structure 30 prior to or during the kiss lapping step, when the softer properties and lower modulus are desired.

Various examples of materials whose shear modulus can be switched from high modulus (i.e., at least 1,000,000 Pa) to low modulus (i.e., no more than 500,000 Pa) have been disclosed above. It is understood that numerous variations of materials could be used and different methods of changing the modulus could be used while maintaining the overall inventive feature and remaining within the scope of the disclosure.

In use, a slider row bar is mounted (e.g., adhesively) to the lapping carrier of this invention. With the modulus-changing material in its high modulus state (i.e., having a shear modulus of at least 1,000,000 Pa or at least 2,000,000 Pa), the slider row bar is lapping in a rough lapping process. After the rough lapping step, a stimulus is applied to the modulus-changing material to change the shear modulus to no more than 500,000 Pa or no more than 300,000 Pa. The stimulus may be a thermal stimulus, electrical, chemical, etc. By use of the modulus-changing material, removing the slider row bar from the carrier and remounting on a softer carrier can be avoided, because the carrier is adaptable for both the rough lapping and the polishing or kiss lapping steps.

Thus, embodiments of the LAPPING CARRIER HAVING HARD AND SOFT PROPERTIES, AND METHODS are disclosed. The implementations described above and other implementations are within the scope of the following claims. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A carrier for a slider row bar for a lapping process, the carrier comprising a mounting structure comprising a material configured to have a first shear modulus of at least 1,000,000 Pa at a first period of time and a second shear modulus of 500 Pa to 500,000 Pa at a second period of time subsequent to the first period, wherein the change from the first shear modulus to the second shear modulus is due to an external stimulus on the material.

2. The carrier of claim 1 wherein the material is a polymeric material and the external stimulus is heat.

3. The carrier of claim 2 wherein when the material has the first shear modulus when the material is at a temperature below its glass transition temperature, and the material has the second shear modulus when the material is at a temperature above its glass transition temperature yet below its melting point.

4. The carrier of claim 2 further comprising a heater.

5. The carrier of claim 1 wherein the material is a polymeric material and the external stimulus is chemical.

6. The carrier of claim 1 wherein the material is a non-polymeric material and the external stimulus is electrical.

7. The carrier of claim 1 wherein the mounting structure comprises multiple layers.

8. The carrier of claim 1 wherein the first shear modulus is at least 2,000,000 Pa and the second shear modulus is no more than 300,000 Pa.

9. A carrier for a slider row bar for a lapping process, the carrier comprising:

a rigid base; and a mounting structure for attachment of the slider row bar thereto, the mounting structure comprising a plurality of layers, with one of the layers configured to have a shear modulus of at least 1,000,000 Pa at a first period of time and a shear modulus of no more than 500,000 Pa at a second period of time subsequent to the first period, wherein the change in modulus is due to an external stimulus on the material.

10. The carrier of claim 9 wherein a second layer of the mounting structure comprises an adhesive for attachment of the slider row bar thereto.

11. The carrier of claim 9 wherein the one of the layers comprises an adhesive for attachment of the slider row bar thereto.

12. The carrier of claim 9 wherein the one of the layers comprises a polymeric material and the external stimulus is heat.

13. The carrier of claim 12 further comprising a heater.

14. The carrier of claim 13 wherein the heater is a thin-film heater.

15. A method of lapping a slider row bar, comprising:

mounting a slider row bar onto a carrier, a portion of the carrier having a first shear modulus;

rough lapping the slider row bar while mounted on the carrier;

applying a stimulus to the carrier to change the first shear modulus to a second shear modulus; and after applying the stimulus, kiss lapping the slider row bar while mounted on the carrier.

16. The method of claim 15 wherein during the step of rough lapping, the shear modulus is at least 1,000,000 Pa.

17. The method of claim 15 wherein during the step of kiss lapping, the shear modulus is no more than 500,000 Pa.

18. The method of claim 15 wherein the stimulus is a temperature change.

19. The method of claim 18 wherein the stimulus is a temperature increase.

20. The method of claim 15 wherein the stimulus is an electrical stimulus.

* * * * *